US005398650A

United States Patent [19]

Venturi

[11] Patent Number: 5,398,650

[45] Date of Patent: Mar. 21, 1995

[54] SEAL DEVICE FOR VALVE ROD OF AN INTERNAL-COMBUSTION ENGINE

[75] Inventor: Stéphane Venturi, La Rochette, France

[73] Assignee: Institut Francais du Petrole, Rueil Malmaison, France

[21] Appl. No.: 255,949

[22] Filed: Jun. 7, 1994

[30] Foreign Application Priority Data

Jun. 7, 1993 [FR] France ..... 93 06785

[51] Int. Cl.[6] ..... F01L 3/08

[52] U.S. Cl. ..... 123/188.6; 123/90.37

[58] Field of Search ..... 123/188.6, 188.9, 90.37

[56] References Cited

U.S. PATENT DOCUMENTS

| | | | |
|---|---|---|---|
| 2,112,045 | 3/1938 | Puffer . | |
| 3,120,221 | 2/1964 | Lyons . | |
| 4,706,967 | 11/1987 | Ochsner | 123/188.6 |
| 4,753,198 | 6/1988 | Heath | 123/188.9 |

FOREIGN PATENT DOCUMENTS

| | | |
|---|---|---|
| 0269587 | 6/1988 | European Pat. Off. . |
| 0435730 | 7/1991 | European Pat. Off. . |
| 1021812 | 2/1953 | France . |

*Primary Examiner*—Raymond A. Nelli
*Assistant Examiner*—Erick Solis
*Attorney, Agent, or Firm*—Antonelli, Terry, Stout & Kraus

[57] ABSTRACT

The object of the present invention is a seal device for a valve rod controlled by a cam included in a camshaft housing of an internal-combustion engine having at least one cylinder.

The device according to the invention includes a pipe (10) connecting on the one hand a feed line (2) for feeding the carbureted mixture into a combustion chamber (1) closed by a valve (5) and, on the other hand, a camshaft housing (4). A nonreturn valve (11) is arranged in said pipe (10) in order to divide said pipe (10) into two volumes (12, 13), the first volume (12) being connected to housing (4) and forming a capacity under pressure having a pressure P1 greater than or equal to the pressure P2 prevailing in feed line (2) and in the second volume (13).

The device according to the invention is intended for preventing fuel leaks from the feed line (2) towards the camshaft housing (4).

4 Claims, 1 Drawing Sheet

SEAL DEVICE FOR VALVE ROD OF AN INTERNAL-COMBUSTION ENGINE

FIELD OF THE INVENTION

The present invention relates to the field of internal-combustion engines having at least one cylinder and each combustion chamber of which is supplied with carbureted mixture under pressure via a feed line which is closed, on the combustion chamber side, by a valve, the motion of each valve being controlled by a cam.

More precisely, the invention provides a seal device for a valve rod intended to prevent fuel leaks from the feed line towards the housing containing the cam or cams.

One tries to prevent such leaks which notably contribute to the fouling of the cam box and to the deterioration of the oil contained in the cam box.

BACKGROUND OF THE INVENTION

It is well-known to seal valve rods by means of a joint surrounding the valve rod and arranged for example on a guide element for guiding the valve rod.

The joints used may wear out, spoil under the effect of the motion of the valve, of temperatures, so that their seal purpose is no longer (or badly) fulfilled after a certain working time.

The present invention notably proposes a solution to the seal problem stated above.

SUMMARY OF THE INVENTION

In fact, the object of the present invention is a seal device for preventing the leaks defined above.

The seal device according to the invention may be substituted for or added to a conventional seal device.

The seal device in accordance with the invention is based on the use of a back pressure.

It is well-known to use a back pressure or an additional pressure to assist the actual motion of the valve. For example, documents U.S. Pat. No. 1,361,109 or FR-2,641,336 disclose valve displacement aid devices based on a pressure difference between two volumes.

In a different way, the back pressure used according to the present invention mainly fulfils the purpose of a seal between two volumes. In fact, according to the present invention, the displacement of each valve is achieved through a cam or an equivalent means. The two functions, displacement and sealing, do not interfere with each other since the displacement is obtained through mechanical means while sealing is achieved with mainly pneumatic means of a different physical nature.

The system according to the present invention is simple, easy to implement and therefore reliable.

It requires no particularly considerable change in the conventional essential elements of the admission system: the valve (the valve seat), the valve rod, the feed line, the cams, the cam box are in no way modified. Their respective functions, proven and known for a long time, remain unchanged.

The aim of the present invention is notably to improve one of the functions related to the injection of fuel into the combustion chamber.

To that effect, the object of the present invention is a seal device for a valve rod controlled by a cam included in a camshaft housing of an internal-combustion engine having at least one cylinder.

According to the invention, the seal device includes a pipe connecting on the one hand a feed line for feeding the carbureted mixture into a combustion chamber closed by a valve and, on the other hand, a camshaft housing, and a nonreturn valve arranged in said pipe in order to divide said pipe into two volumes, the first volume being connected to the housing and forming a capacity under pressure having a pressure P1 greater than or equal to the pressure P2 prevailing in the feed line and in the second volume, said device being intended to prevent fuel leaks from the feed line towards the camshaft housing.

According to an embodiment of the invention, the second volume is connected to a pump crank case of a cylinder of the internal-combustion engine.

According to another embodiment of the invention, the second volume is connected to a compressor exterior to the cylinder.

According to a particular embodiment of the invention, the feed line is supplied with compressed air and it includes a pneumatic fuel injector, so that said valve acts as a pneumatic injector for spraying said fuel into the combustion chamber.

BRIEF DESCRIPTION OF THE DRAWINGS

Other features and advantages of the invention will be clear from reading the description hereafter given by way of non limitative examples, with reference to the accompanying drawings in which.

DESCRIPTION OF THE PREFERRED EMBODIMENTS

Figure 1:
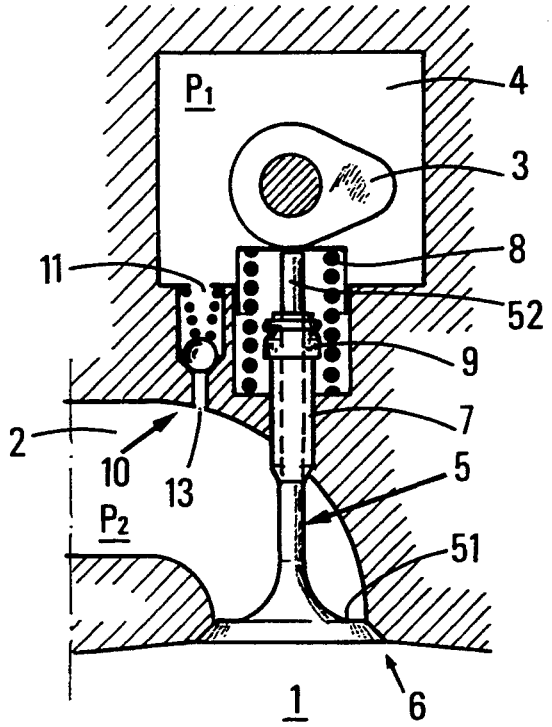
FIG. 1 diagrammatically shows a part of an engine including a seal device according to an embodiment of the invention, and FIG. 2 diagrammatically shows a part of an engine including a seal device according to another embodiment of the invention.

In FIG. 1, reference number 1 refers to the combustion chamber, the feed line bears reference number 2, a cam bears reference number 3 and reference number 4 refers to the cam box. Valve 5 includes, on the combustion chamber side 1, a tulip-shaped end 51 closing the intake port 6 and resting on a seat (not referenced). Valve 5 also includes a rod 52 extending tulip-shaped end 51 and guided in translation by a guide or an equivalent means 7. An elastic return means 8 pushes valve 5 against cam 3, which tends to bring the tulip-shaped end 51 back onto its seat, i.e. to close port 6, contrarily to cam 3 which pushes valve 5 into the opposite direction and tends to open port 6.

A seal element 9 such as a joint may be provided for example at the level of return element 8 in order to form a first seal between feed line 2 and cam box 4. The fluid under pressure circulating in line 2 may consist for example of a mixture of air and of fuel. The fuel may tend to accumulate along valve rod 52 and to infiltrate beyond seal element 9.

It is well-known that element 9 is particularly efficient for preventing leaks in the direction of cam box 4 towards line 2, but it is very little efficient for preventing leaks from line 2 towards cam box 4. This latter function is that for which efficiency is sought according to the invention.

On the basis of this observation, the present invention thus proposes another seal device which, as it has already been stated, may be substituted for or added to a known seal device 9 for example.

The seal device according to the invention notably includes a pipe 10 connecting feed line 2 to cam box 4. A nonreturn valve 11 or any other means intended for allowing passage of the fluid under the effect of a given pressure difference and for preventing its passage when the pressure difference is less than the given pressure difference is also arranged in pipe 10.

Nonreturn valve 11 thus allows pipe 10 to be divided into two volumes, the first volume 12 being connected to cam box 4 and the second volume 13 communicating with feed line 2. A pressure P1 prevails in the first volume 12 and a pressure P2 prevails in the second volume 13. Valve 11 opens when pressure P2 is greater than pressure P1, volume 12 playing thus the part of a pressure storage capacity.

It must be pointed out that, according to the embodiment of FIG. 1, volume 12 is actually nearly non-existent, so that pressure P1 is the pressure prevailing in cam box 4.

Figure 2:
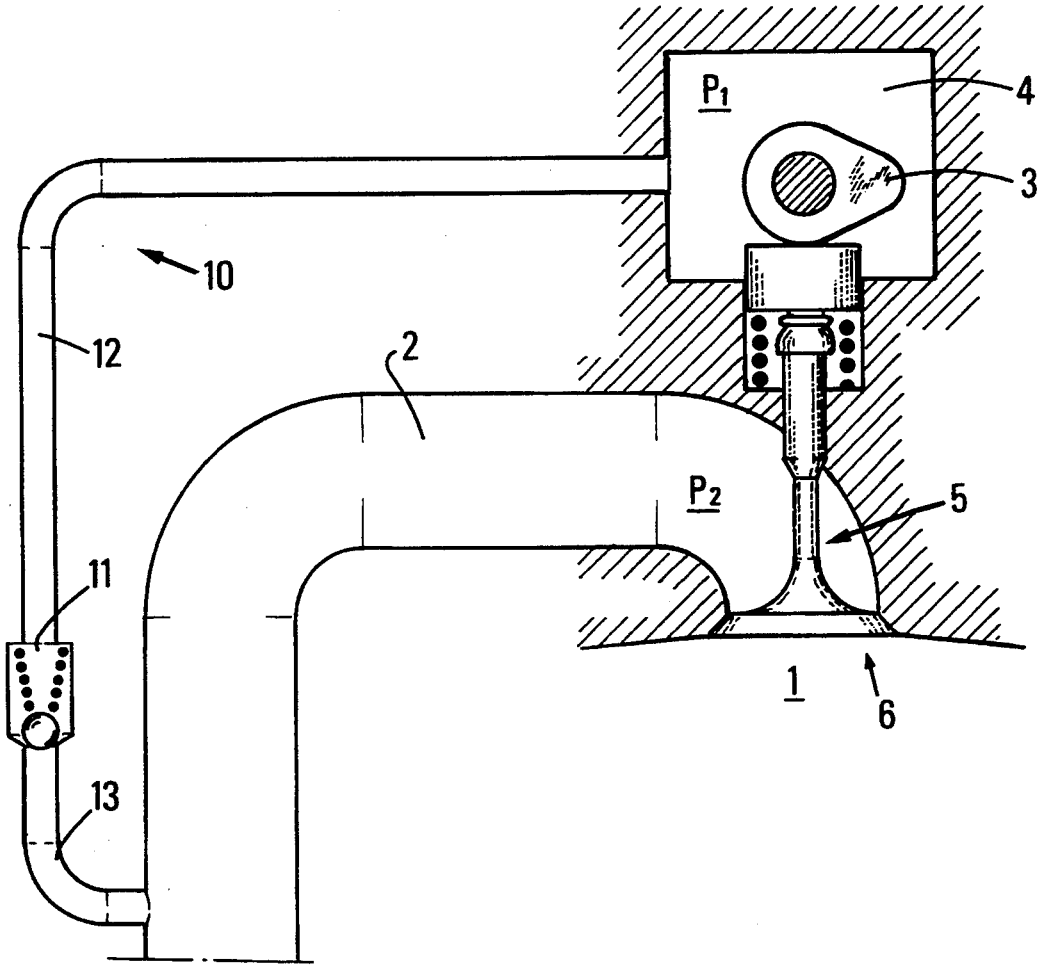

FIG. 2 shows an embodiment in which volume 12 appears clearly.

The embodiments of FIGS. 1 and 2 differ notably in the place into which pipe 10 opens:

In FIG. 1, pipe 10 opens towards the combustion chamber 1 close to intake port 6, while in FIG. 2, the branch connection is placed more upstreams.

Line 2 may for example convey a fluid having the pressure of the pump crankcase, a pressure which of course varies during each engine cycle.

Nonreturn valve 11 thus allows the maximum pressure P1 obtained during each cycle to be stored in volume 12 and in space 4. This pressure acts, notably at the level of the rod 52 of valve 5, against the pressure P2 prevailing close to intake port 6 and which is inevitably less than or at most equal to P1.

Valve 5 may be used to perform a pneumatic fuel injection into combustion chamber 1, from compressed air taken for example in the pump crankcase of a two-stroke engine.

Without departing from the scope of the invention, the compressed air may be supplied by a compressor exterior to the cylinder.

A fuel introduction device (not shown in the figures) may be provided. It may open into feed line 2, so that the valve then fulfils a function of pneumatic injection of fuel into the combustion chamber.

Of course, the device which has been described may be provided with other modifications and/or improvements by the man skilled in the art without departing from the scope of the present invention.

I claim:

1. A seal device for a valve rod controlled by a cam included in a camshaft housing of an internal-combustion engine having at least one cylinder, comprising a pipe (10) connected at a first end to a feed line (2) for feeding a carbureted mixture into a combustion chamber (1) closed by a valve (5), and connected at a second end to a camshaft housing (4), the device further comprising a nonreturn valve (11) arranged in said pipe (10) in order to divide said pipe (10) into two volumes (12, 13), the first volume (12) being connected to the housing (4) and forming a capacity under pressure having a pressure P1 higher than or equal to the pressure P2 prevailing in the feed line (2) and in the second volume (13), said device being intended to prevent fuel leaks from the feed line (2) towards the camshaft housing (4).

2. A seal device as claimed in claim 1, wherein the second volume (13) is connected to a pump crankcase of a cylinder of the internal-combustion engine.

3. A seal device as claimed in claim 1, wherein the second volume (13) is connected to a compressor exterior to the cylinder.

4. A device as claimed in claim 1, wherein the feed line (2) is supplied with compressed air and includes a pneumatic fuel injector, so that said valve (5) acts as a pneumatic injector for spraying said fuel into combustion chamber (1).

* * * * *